US011612807B2

(12) United States Patent
Morris

(10) Patent No.: US 11,612,807 B2
(45) Date of Patent: Mar. 28, 2023

(54) PUZZLE STORAGE BOX

(71) Applicant: David Charles Morris, Austin, TX (US)

(72) Inventor: David Charles Morris, Austin, TX (US)

( * ) Notice: Subject to any disclaimer, the term of this patent is extended or adjusted under 35 U.S.C. 154(b) by 0 days.

(21) Appl. No.: 17/538,426

(22) Filed: Nov. 30, 2021

(65) Prior Publication Data

US 2022/0168628 A1 Jun. 2, 2022

Related U.S. Application Data

(60) Provisional application No. 63/119,563, filed on Nov. 30, 2020.

(51) Int. Cl.

| | |
|---|---|
| ***A63F 9/00*** | (2006.01) |
| ***A63F 9/08*** | (2006.01) |
| ***B65D 43/02*** | (2006.01) |

(52) U.S. Cl.

CPC ..... *A63F 9/001* (2013.01); *A63F 9/08* (2013.01); *B65D 43/0229* (2013.01); *A63F 2009/0012* (2013.01); *B65D 2543/005* (2013.01); *B65D 2543/00203* (2013.01); *B65D 2543/00546* (2013.01)

(58) Field of Classification Search

CPC .... A63F 9/001; A63F 9/08; A63F 2009/0012; A63F 9/0826; A63F 2009/0053; A63F 2250/24; B65D 43/0229; B65D 2543/00203; B65D 2543/005; B65D 2543/00546; B65D 50/04

USPC ..... 273/156

See application file for complete search history.

(56) References Cited

U.S. PATENT DOCUMENTS

| | | | | | |
|---|---|---|---|---|---|
| 1,029,820 | A * | 6/1912 | Oblein | B65D 50/045 | 70/289 |
| 1,111,337 | A * | 9/1914 | Watkins | A63F 9/0876 | 411/941.3 |
| 1,410,295 | A * | 3/1922 | Hammond | A63F 7/044 | 273/115 |
| 1,765,019 | A * | 6/1930 | Maxwell | A63F 7/386 | 273/109 |
| 2,794,645 | A * | 6/1957 | La Montagne | A63F 9/083 | 273/156 |
| 3,630,168 | A * | 12/1971 | Findlay | G01P 15/036 | 73/11.01 |
| 3,650,379 | A * | 3/1972 | La Montagne | A45C 1/12 | 273/156 |

(Continued)

FOREIGN PATENT DOCUMENTS

| | | | | |
|---|---|---|---|---|
| EP | 1240983 | A2 * | 9/2002 | B25B 21/00 |

*Primary Examiner* — Steven B Wong

(74) *Attorney, Agent, or Firm* — Pharar Patents & Intellectual Property; Andrew A. Pharar

(57) ABSTRACT

The puzzle storage box disclosed herein may comprise an internal locking mechanism designed to challenge ingenuity while being embedded within an assembly of unlimited form potentiality. In one variation, the internal locking mechanism is embedded in a shallow container and may be used for more personal, everyday carry. In another variation, the internal locking mechanism is embedded in a deeper container for increased volume and prominent display. The internal locking mechanism will be incorporated into endless shapes and forms, and its novel method of operation will be respectively conveyed.

2 Claims, 17 Drawing Sheets

(56) References Cited

U.S. PATENT DOCUMENTS

| | | | | |
|---|---|---|---|---|
| 4,397,466 | A * | 8/1983 | Nichols | A63F 9/088 273/156 |
| 5,667,221 | A * | 9/1997 | Lievre | A63F 7/382 273/109 |
| 2013/0025901 | A1 * | 1/2013 | Shi | B25B 21/00 173/216 |

* cited by examiner

PUZZLE STORAGE BOX

TECHNICAL FIELD OF THE INVENTION

The present invention relates in general to locking storage devices, and, more specifically, to a puzzle storage box.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Customers increasingly seek ways to prevent valuables from being accessed by others. Additionally, interest in tangible puzzles, brain-teasers, mental games, and fidget devices has been on the rise. These challenges range from digital games to physical objects and keepsakes (Rubik's Cube, Fidget Spinners, et al). Consumer products are continually created in an attempt to sate curious and inquisitive minds, albeit few simultaneously offer utility or purpose.

Secure containers of various kinds, including pill and medicine bottles, storage and jewelry boxes, and other products are frequently sought for both utility and recreational needs. These secure containers may also double as a puzzle, requiring skill and/or technique to operate or open; and are comprised of one or a plurality of internal locking mechanisms interacting with both internal and external components. In one exemplary mechanism, a plurality of ball-bearings is radially forced to the limits of their respective channels, allowing the manipulation of additional components.

In another exemplary mechanism, the plurality of ball-bearings may not be radially forced to the limits of their channels, preventing the manipulation of additional components. In another exemplary mechanism, the plurality of ball-bearings may be compressed against internal components, preventing the manipulation of additional components. In another exemplary mechanism, the manipulation of additional components may be prevented by inverting the mechanism or assembly.

Thus, there is a need in the art for a puzzle storage box that may comprise an internal locking mechanism designed to challenge ingenuity while being embedded within an assembly of unlimited form potentiality. In one variation, the internal locking mechanism is embedded in a shallow container and may be used for more personal, everyday carry. In another variation, the internal locking mechanism is embedded in a deeper container for increased volume and prominent display. The internal locking mechanism will be incorporated into endless shapes and forms, and its novel method of operation will be respectively conveyed. It is to these ends that the present invention has been developed.

BRIEF SUMMARY OF THE INVENTION

To minimize the limitations in the prior art, and to minimize other limitations that will be apparent upon reading and understanding the present specification, the present invention describes a puzzle storage box.

It is an objective of the present invention to provide a puzzle storage box that may comprise an internal locking mechanism.

It is another objective of the present invention to provide a puzzle storage box that may comprise a lid component.

It is another objective of the present invention to provide a puzzle storage box that may comprise a plate component.

It is another objective of the present invention to provide a puzzle storage box that may comprise a cup component.

It is another objective of the present invention to provide a puzzle storage box that may comprise a base component.

It is another objective of the present invention to provide a puzzle storage box that may comprise an insert.

It is another objective of the present invention to provide a puzzle storage box that may comprise a plurality of ball bearings.

It is another objective of the present invention to provide a puzzle storage box that may comprise a resilient material of construction.

It is another objective of the present invention to provide a puzzle storage box that may comprise a water-proof material of construction.

It is another objective of the present invention to provide a puzzle storage box that may comprise a reusable material of construction.

It is another objective of the present invention to provide a puzzle storage box that may comprise an antimicrobial layer.

It is another objective of the present invention to provide a puzzle storage box that may comprise an antimicrobial material of construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 11 4 is a bottom plan view of the base component, as contemplated by the present disclosure;

FIG. 12 4 is a side elevation view of the base component, as contemplated by the present disclosure;

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The puzzle storage box disclosed herein may comprise an internal locking mechanism designed to challenge ingenuity while being embedded within an assembly of unlimited form potentiality. In one variation, the internal locking mechanism is embedded in a shallow container and may be used for more personal, everyday carry. In another variation, the internal locking mechanism is embedded in a deeper container for increased volume and prominent display. The internal locking mechanism will be incorporated into endless shapes and forms, and its novel method of operation will be respectively conveyed.

An internal locking mechanism is disclosed. A base may include a void for a cup and may include channels for both a cup and/or ball-bearings to traverse within. A cup may have a single void or contain multiple partitions within and may have protruding tabs. A plate may secure the cup into the base void and may have voids to accept the lid. A lid may be inserted through the plate voids and may interlock with the base and cup. Ball-bearings may be used to traverse channels and may either allow or hinder the movement of the mated cup and lid.

Alternately or additionally, the exterior shape of the final assembly is not limited to geometrically symmetrical configurations, shapes or sizes. For example, the exterior shape may take the form of a rock or a prism.

The illustrations of FIGS. 1-5 illustrate a puzzle storage box, as contemplated by the present disclosure. The device may comprise, generally, a lid component, a plate component, a cup component, and a base component.

Figure 1:
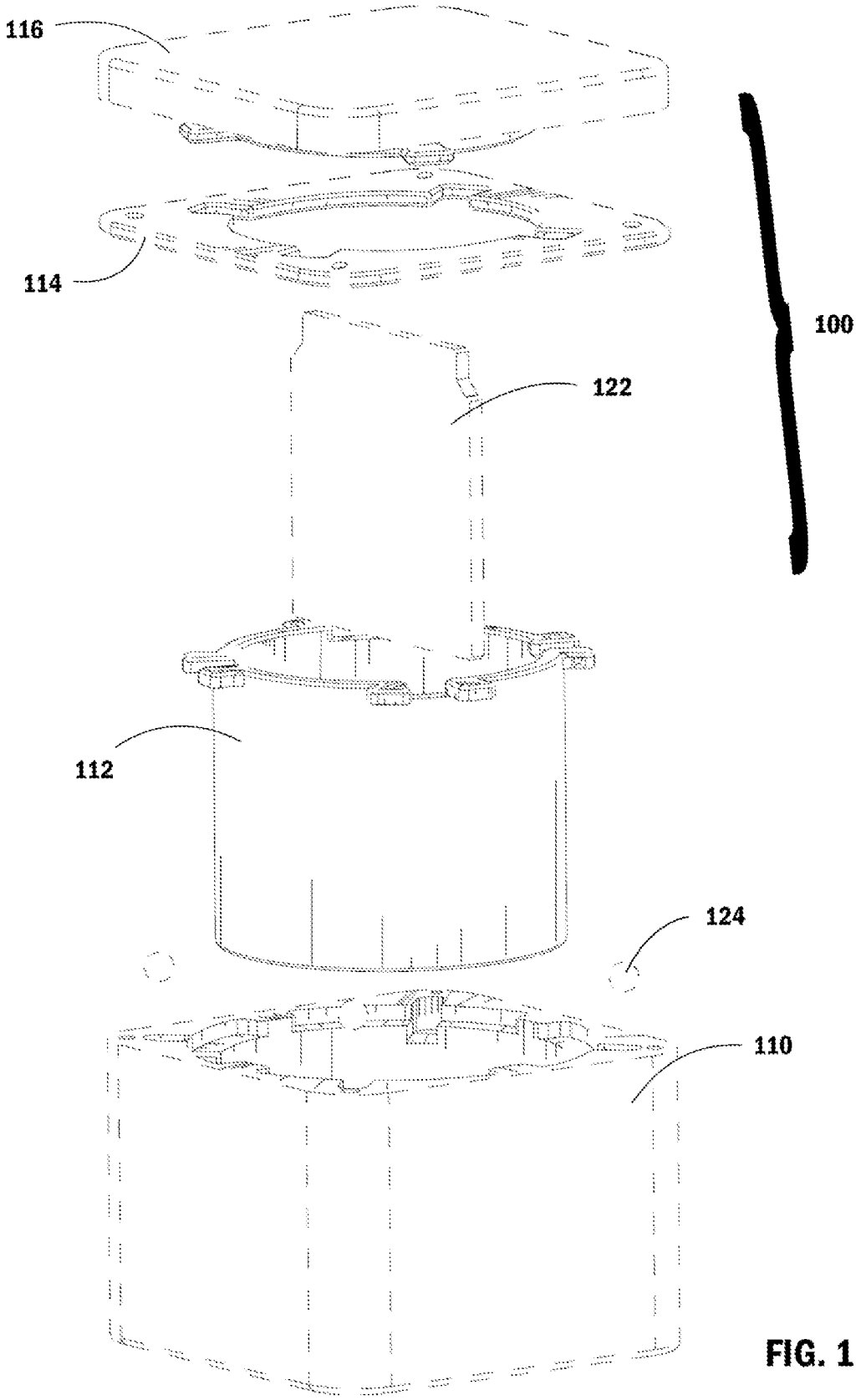
FIG. 1 is an exploded perspective view showing an internal locking mechanism assembly including, from top to bottom: a lid component, a plate component, a cup component and a base component, as contemplated by the present disclosure.

The illustration of FIG. 1, a first internal locking mechanism assembly 100, in exploded view, may include a base 110, a cup 112, a plate 114, a lid 116, and an insert 122. The base 110, cup 112, plate 114, lid 116, and insert 122 may mate or join in an axial direction, and may or may not rotate with respect to each other's relative position.

Figure 2:
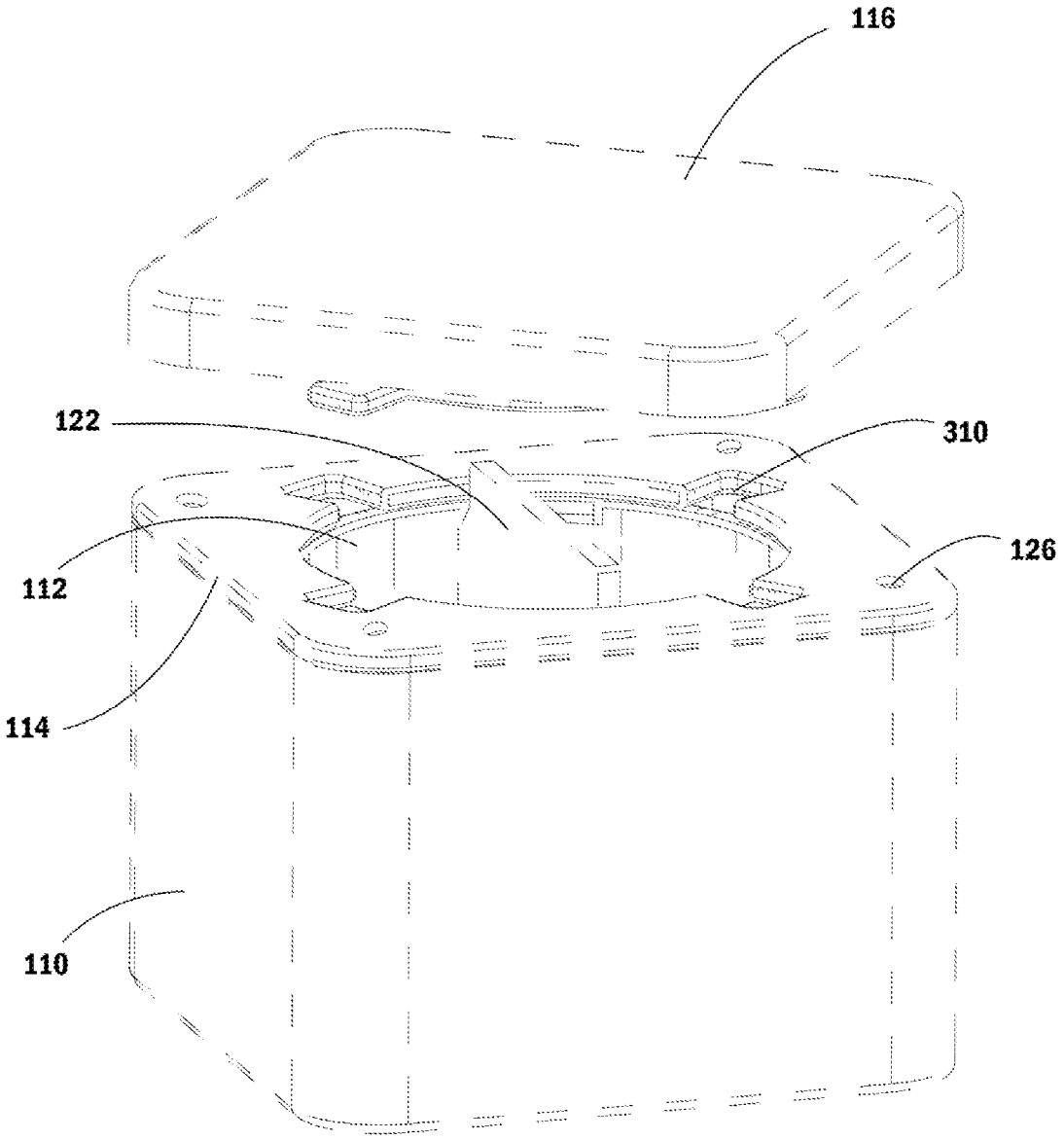
FIG. 2 is a perspective view showing the lid component in an exploded state with the three underlying components in an assembled state, as contemplated by the present disclosure.

The illustration of FIG. 2 represents a partially assembled internal locking mechanism assembly 100 with the cup 112 contained between the base 110 and plate 114 and secured by means of a screw 126. An insert 122 may be situated within the cup 112. The lid 116 may be uncontained while the internal locking mechanism assembly 100 is in an open configuration.

Figure 3:
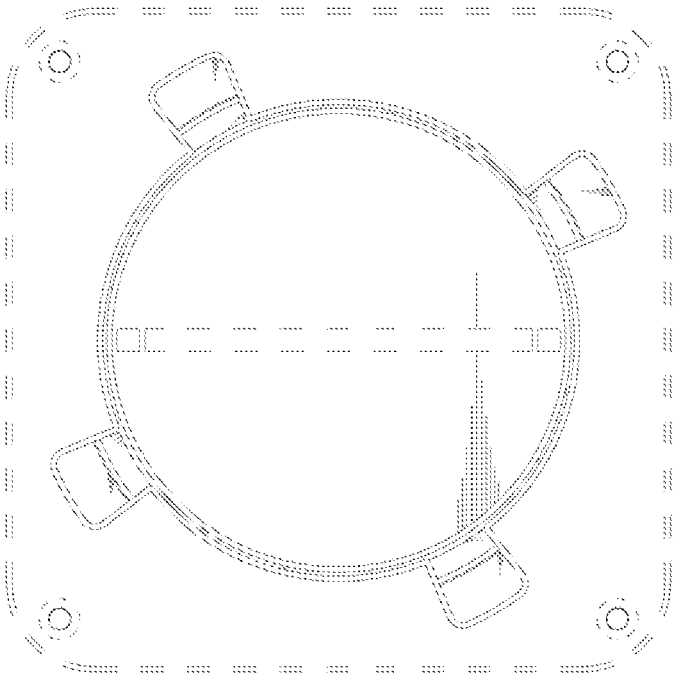
FIG. 3 is a top perspective view of the base component with plate component, as contemplated by the present disclosure.
Figure 4:
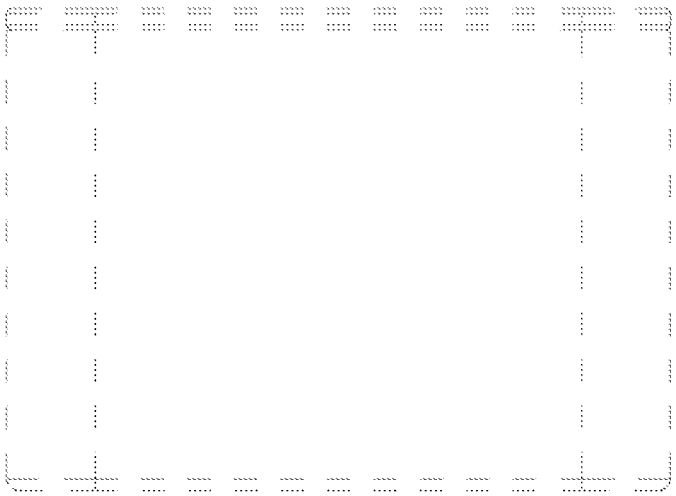
FIG. 4 is a side elevation view of the base component with plate component, as contemplated by the present disclosure.

The illustrations of FIG. 3 and FIG. 4 represent the individual base 110 component and may contain a base void 210, a cup channel 212, a bearing channel 214, and a screw hole 220. The base void 210 and cup channel 212 may receive a cup 112. The bearing channel 214 may receive a bearing 124. The bearing channel 214 may have a ramp.

Figure 5:
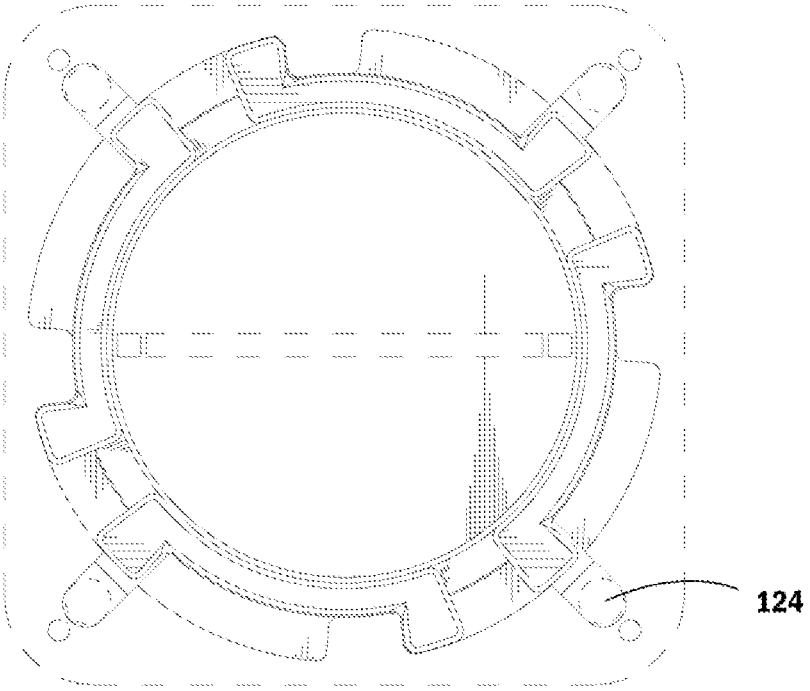
FIG. 5 is a top perspective view of the base component with cup component, as contemplated by the present disclosure.

The illustration of FIG. 5 represents the individual cup 112 component and may include an insert 122, a lid tab void 310, and a cup tab 312.

Figure 6:
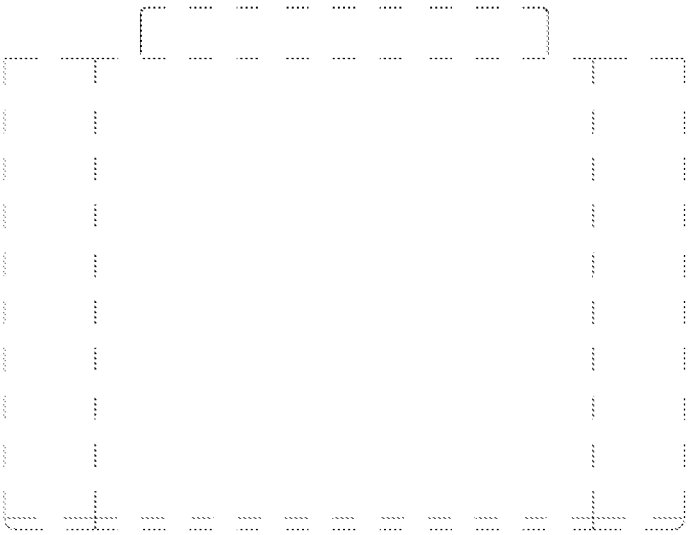
FIG. 6 is a side elevation view of the base component with cup component, as contemplated by the present disclosure.
Figure 7:
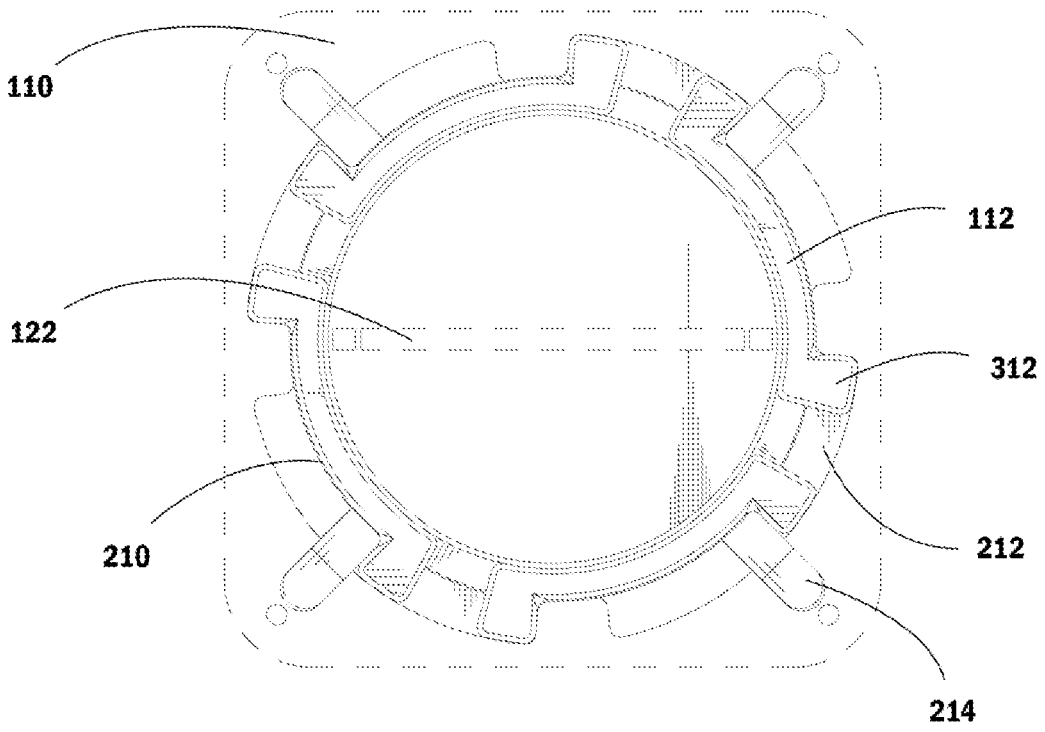
FIG. 7 is a top plan view of the cup and base components with the cup element shifted to an alternate position, as contemplated by the present disclosure.

The illustrations of FIG. 6 and FIG. 7 represent the cup 112 component as situated within the base 110 and the base void 210. While seated within the base 110, the cup 112 is allowed limited motion as constrained by the cup tab 312 traversing inside the cup channel 212. In comparing FIG. 6 with FIG. 7, it can be observed the cup 112 has rotated to position the cup tab 312 as either inline with or offset from the bearing channel 214.

Figure 8:
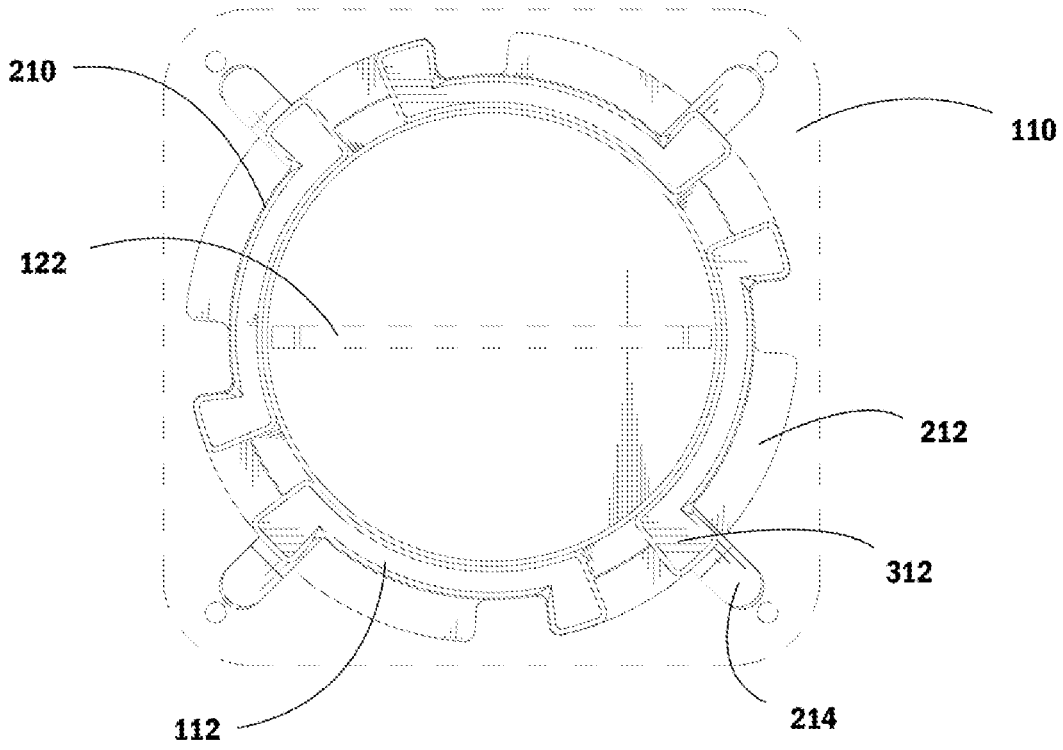
FIG. 8 is an alternate top plan view of the cup and base components with the cup element shifted to an alternate position, as contemplated by the present disclosure.
Figure 9:
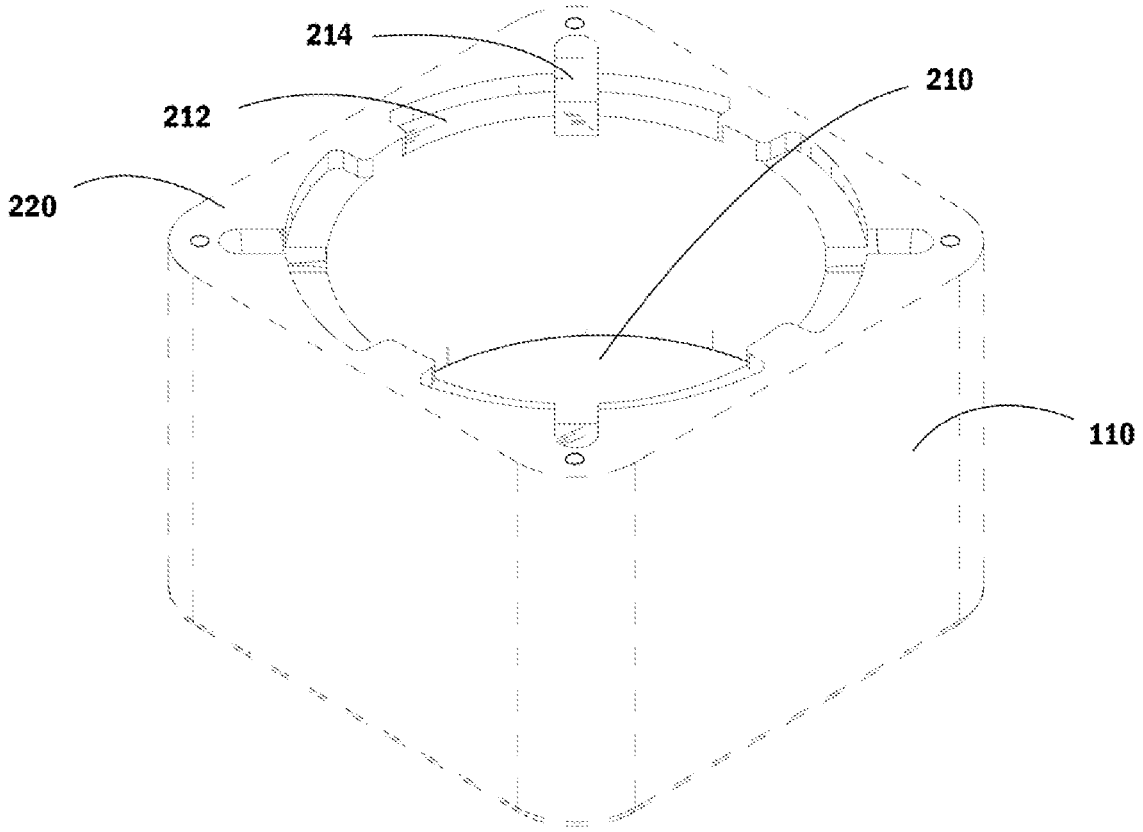
FIG. 9 is a top perspective view of the base component, as contemplated by the present disclosure.

The illustrations of FIG. 8 and FIG. 9 represent the individual plate 114 component and may include a lid tab void 310, a lid collar void 412, an invert locking ramp 414, a plate face 416, a plate underside 418, and a screw hole 420.

Figure 10:
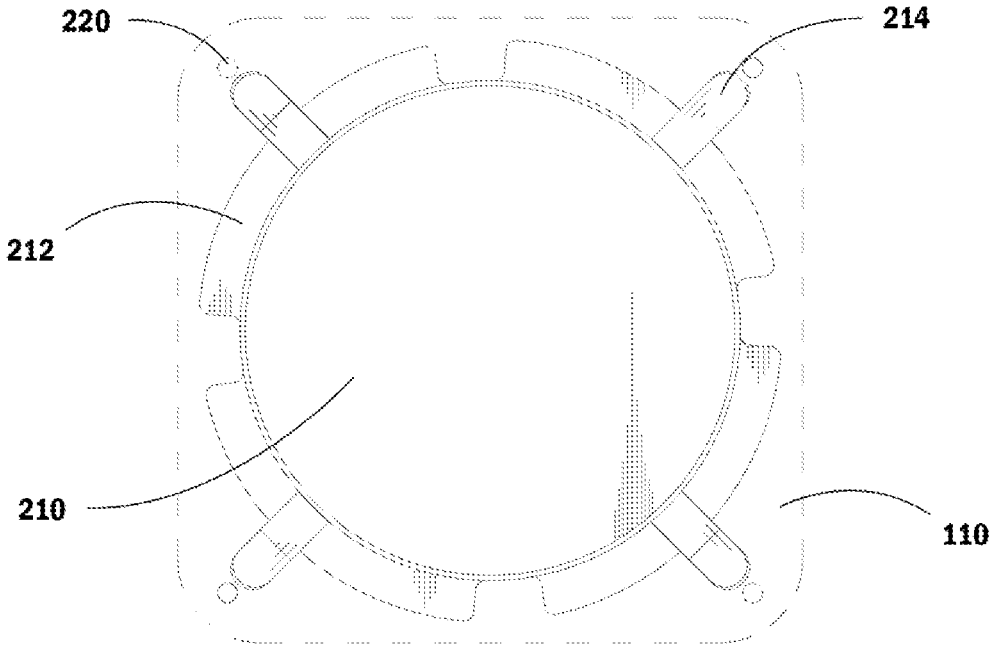
FIG. 10 is a top plan view of the base component, as contemplated by the present disclosure.
Figure 11:
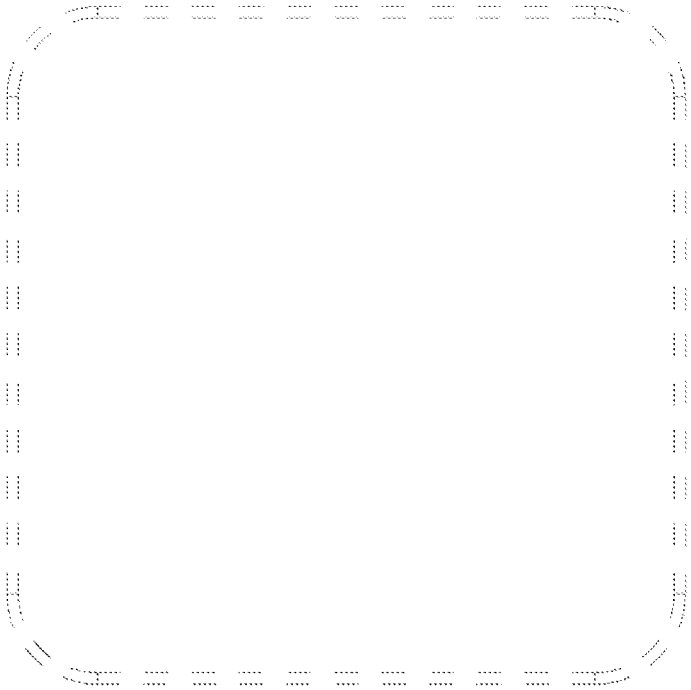

The illustrations of FIG. 10 and FIG. 11 represent the individual lid 116 component and may include a lid tab 510 and a lid collar 512.

Figure 12:
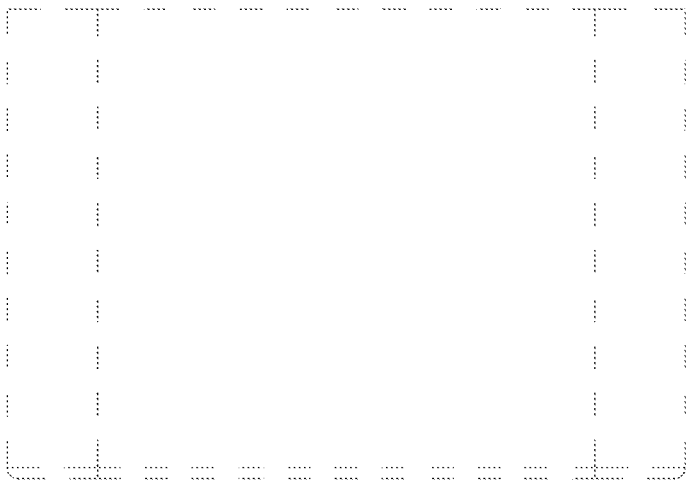
Figure 13:
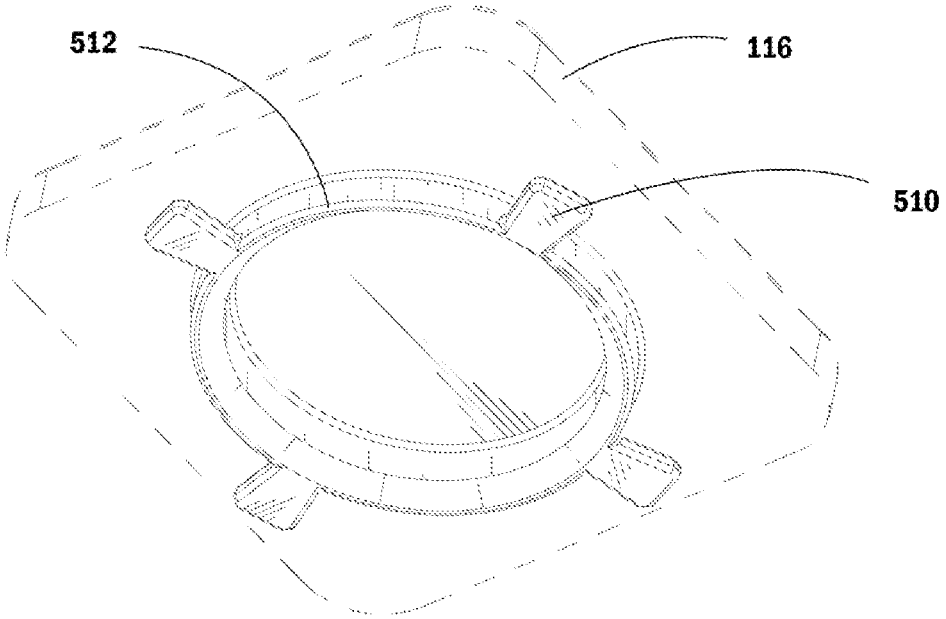
FIG. 13 is a bottom perspective view of the lid component, as contemplated by the present disclosure.
Figure 14:
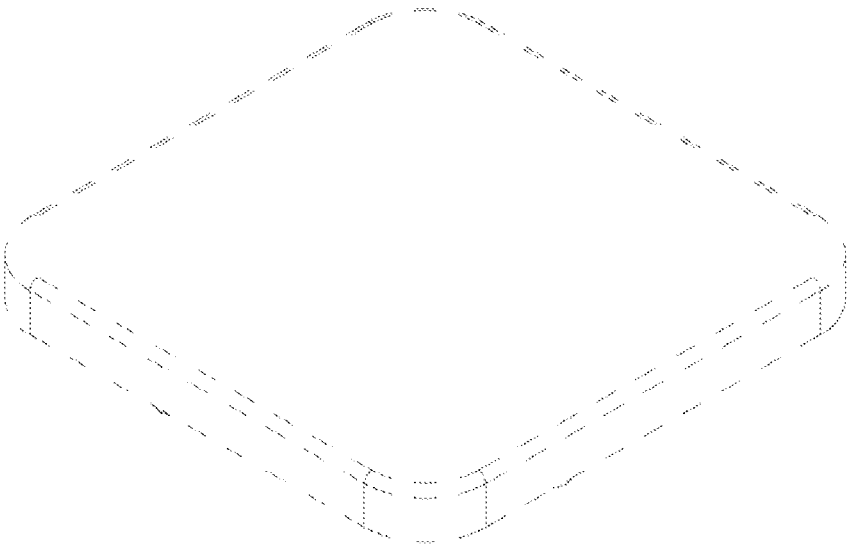
FIG. 14 is a top perspective view of the lid component, as contemplated by the present disclosure.
Figure 15:
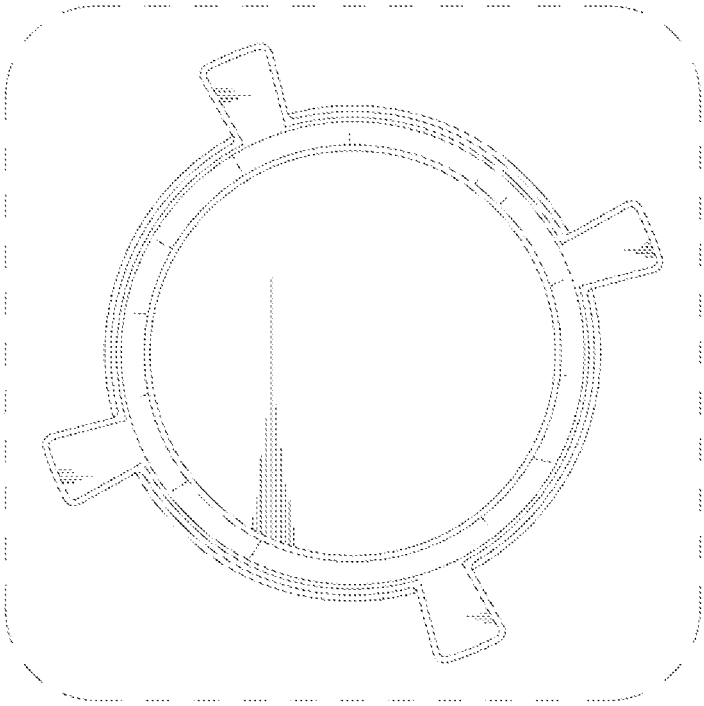
FIG. 15 is a bottom plan view of the lid component, as contemplated by the present disclosure.
Figure 16:
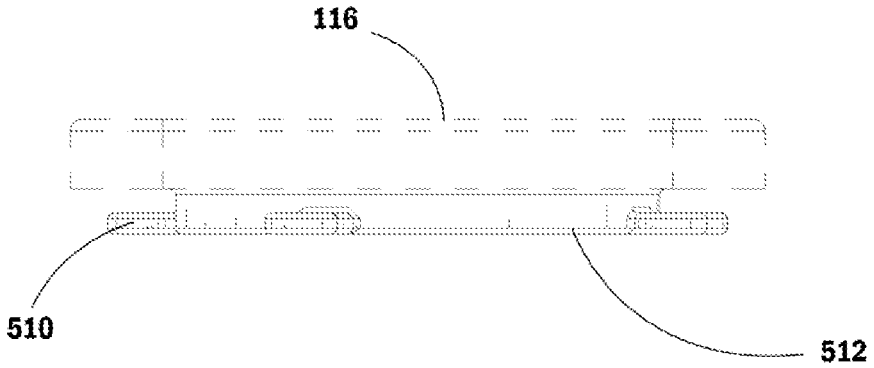
FIG. 16 is a side elevation view of the lid component, as contemplated by the present disclosure.
Figure 17:
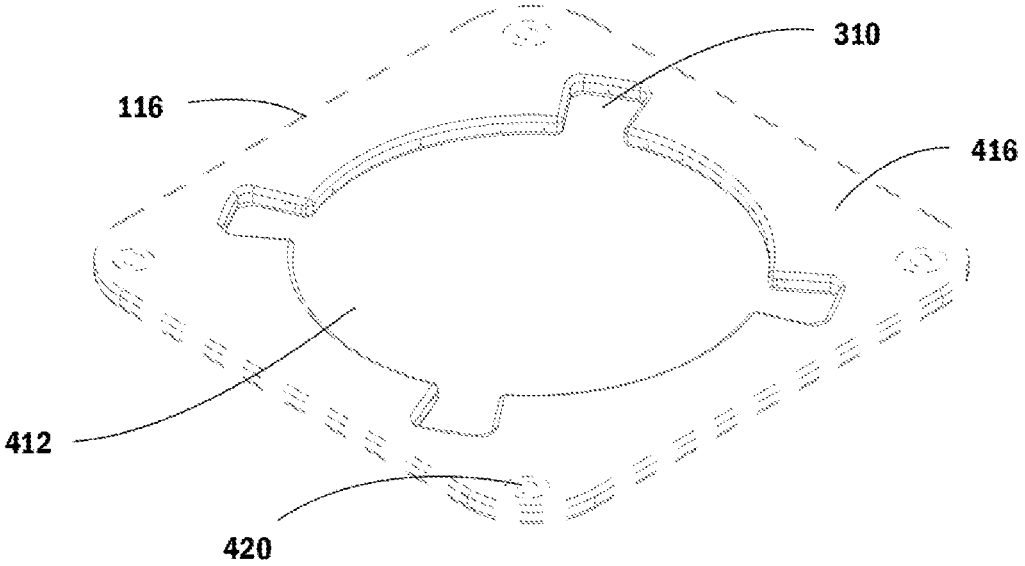
FIG. 17 is a top perspective view of the plate component, as contemplated by the present disclosure.
Figure 18:
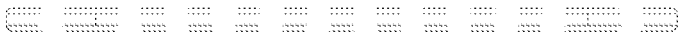
FIG. 18 is a side elevation view of the plate component, as contemplated by the present disclosure.
Figure 19:
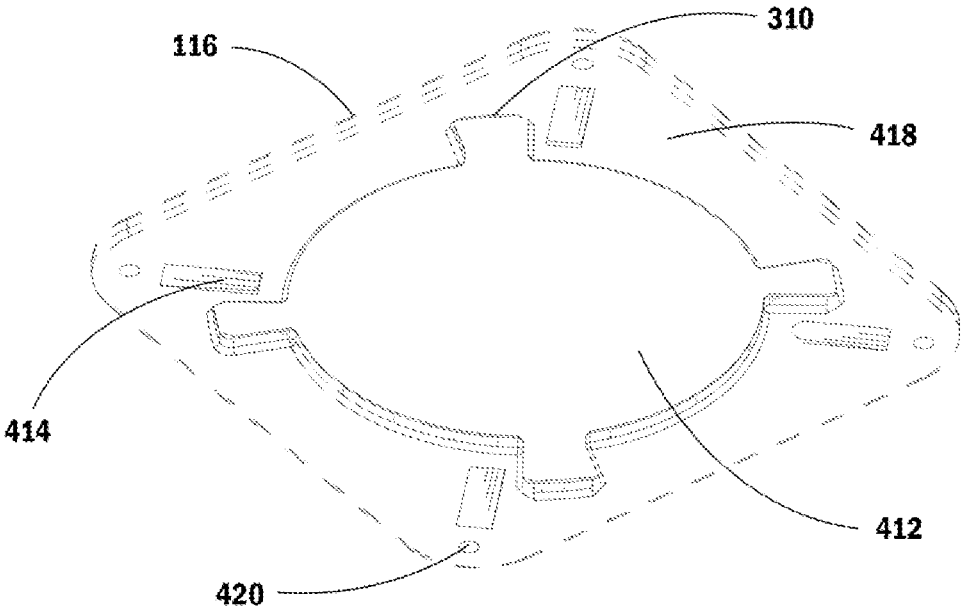
FIG. 19 is a bottom perspective view of the plate component, as contemplated by the present disclosure.
Figure 20:
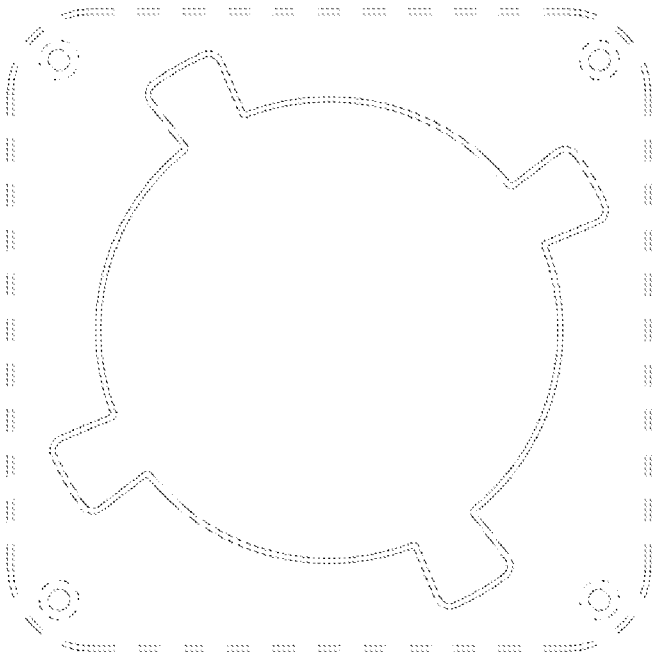
FIG. 20 is a top plan view of the lid component, as contemplated by the present disclosure.
Figure 21:
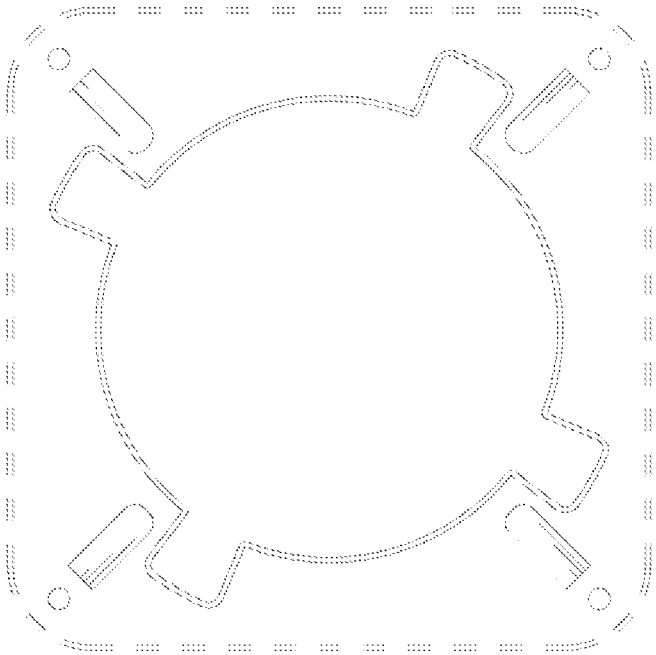
FIG. 21 is a bottom plan view of the lid component, as contemplated by the present disclosure.
Figure 22:
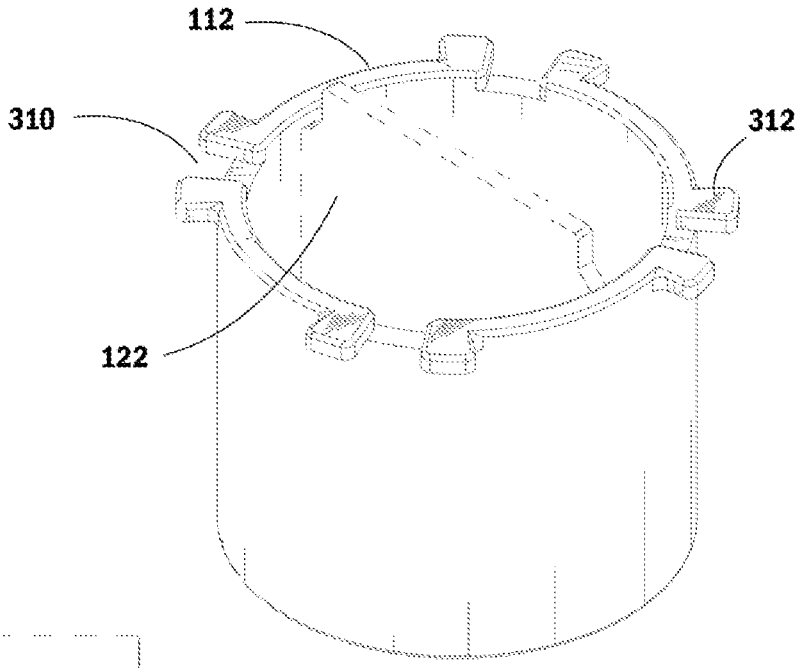
FIG. 22 is a top perspective view of the cup component, as contemplated by the present disclosure.
Figure 23:
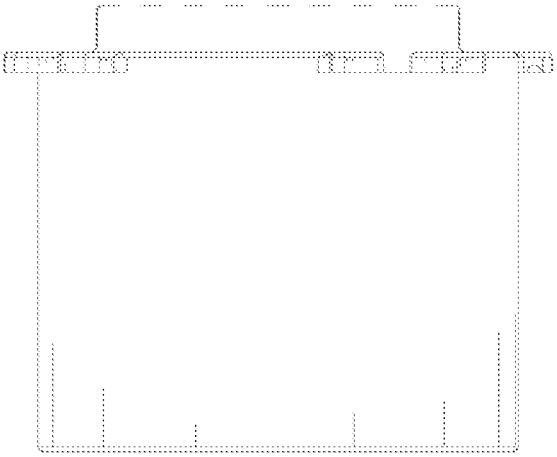
FIG. 23 is a side elevation view of the cup component, as contemplated by the present disclosure.
Figure 24:
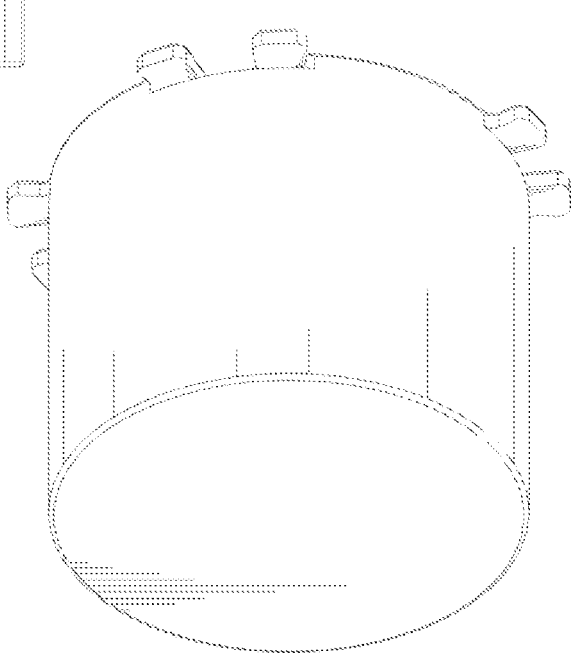
FIG. 24 is a bottom perspective view of the cup component, as contemplated by the present disclosure.
Figure 25:
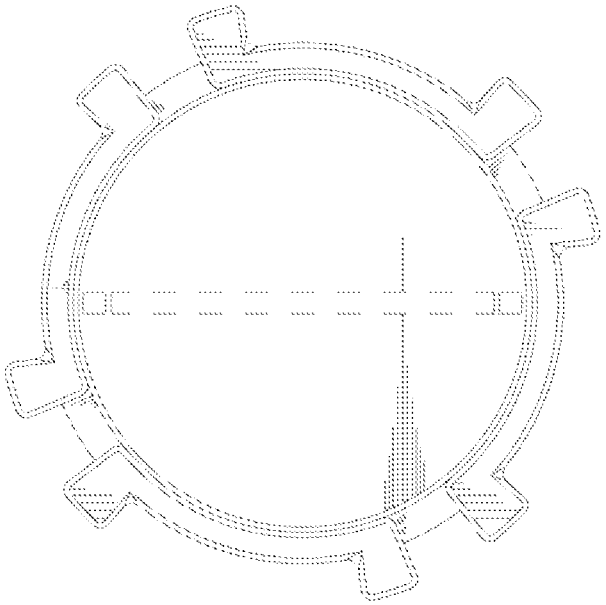
FIG. 25 is a top plan view of the cup component, as contemplated by the present disclosure.
Figure 26:
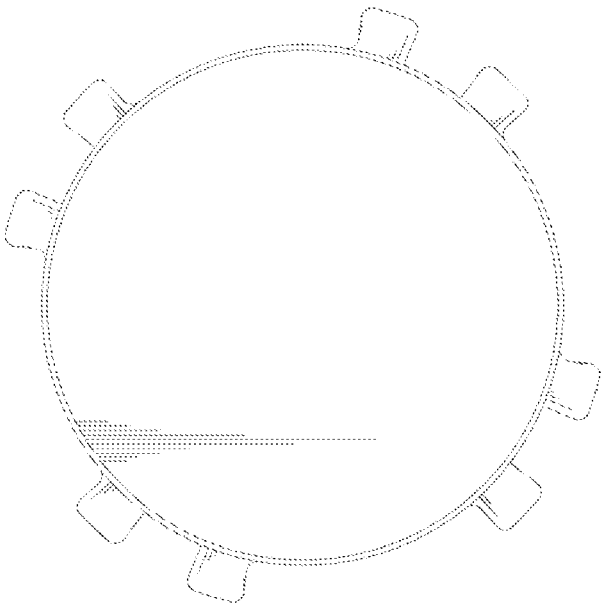
FIG. 26 is a bottom plan view of the cup component, as contemplated by the present disclosure.
Figure 27:
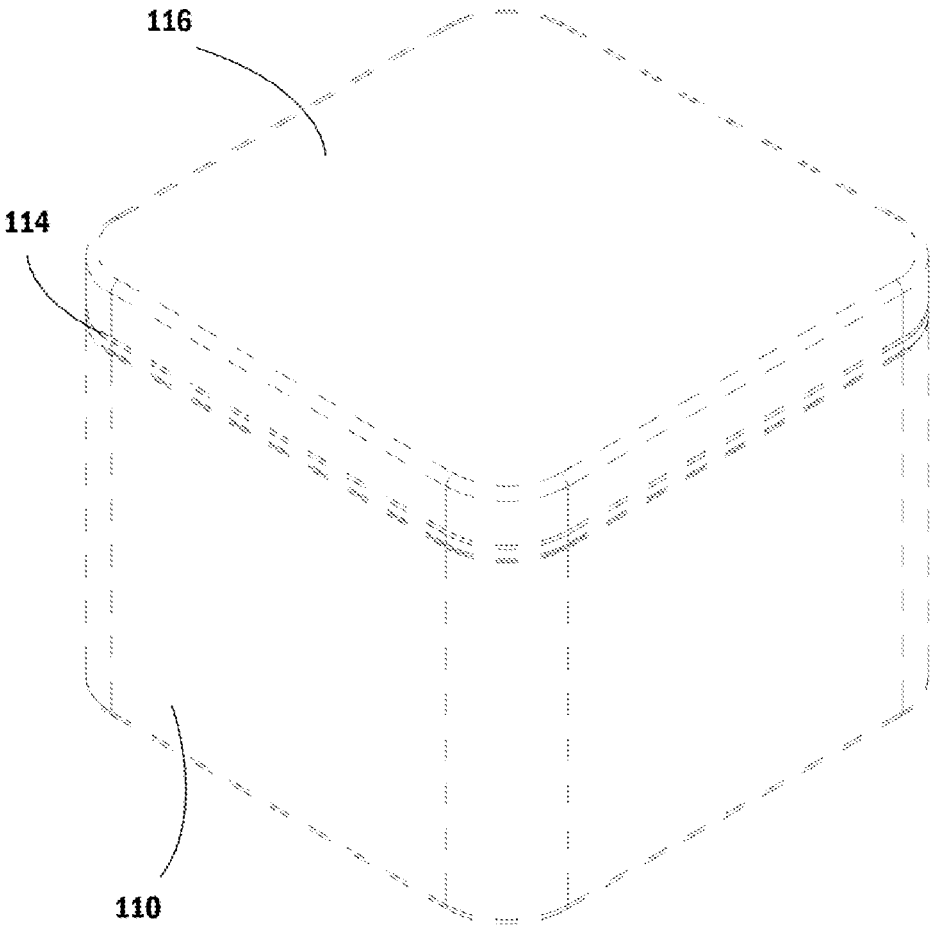
FIG. 27 is a top perspective view of the assembled puzzle box, as contemplated by the present disclosure.
Figure 28:
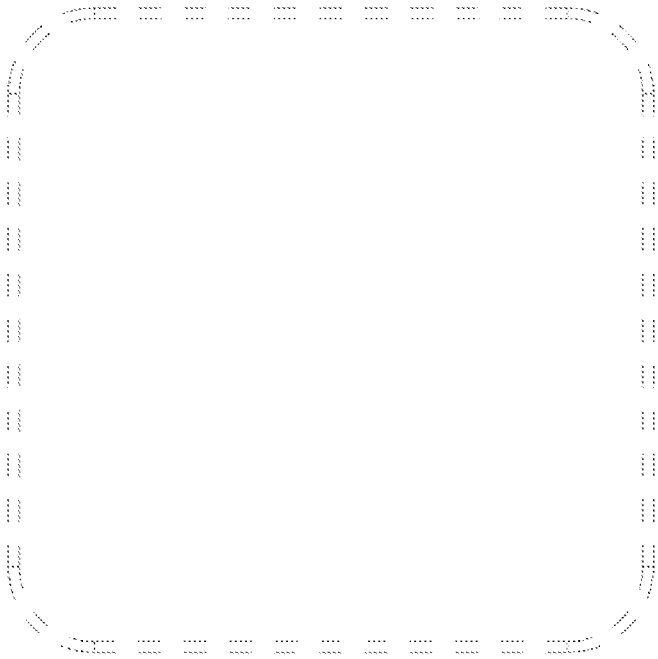
FIG. 28 is a top plan view of the assembled puzzle box, as contemplated by the present disclosure.
Figure 29:
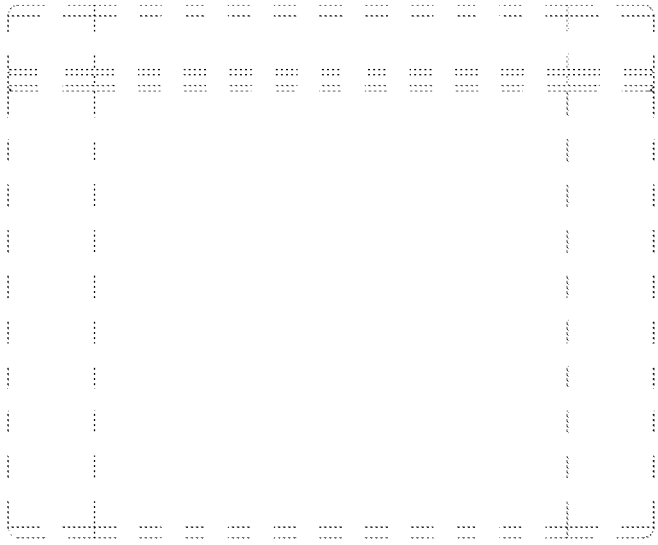
FIG. 29 is a side elevation view of the assembled puzzle box, as contemplated by the present disclosure.
Figure 30:
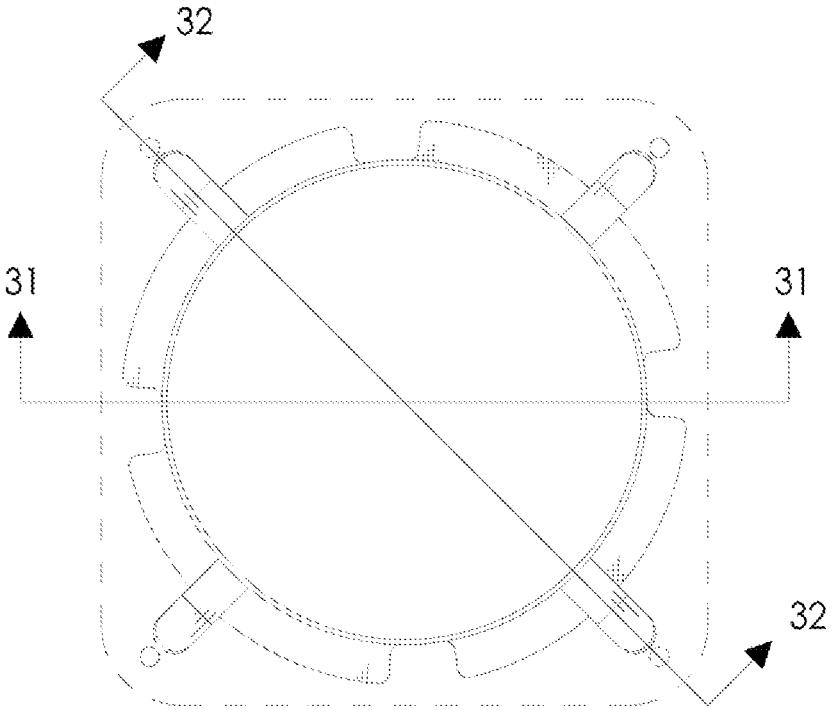
FIG. 30 is a top plan view of the assembled puzzle box, as contemplated by the present disclosure.
Figure 31:
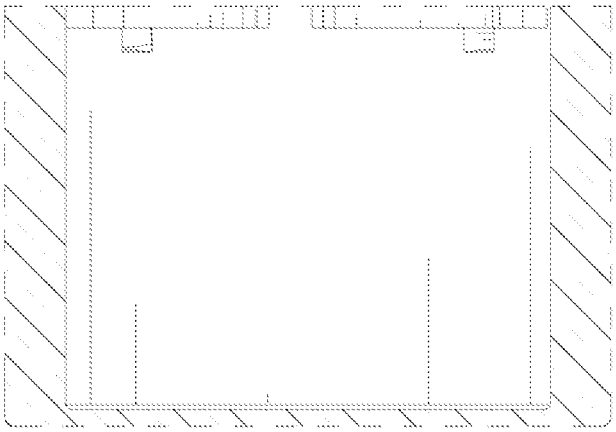
FIG. 31 is a hemisection view of the assembled puzzle box along line 31 of FIG. 30, as contemplated by the present disclosure.
Figure 32:
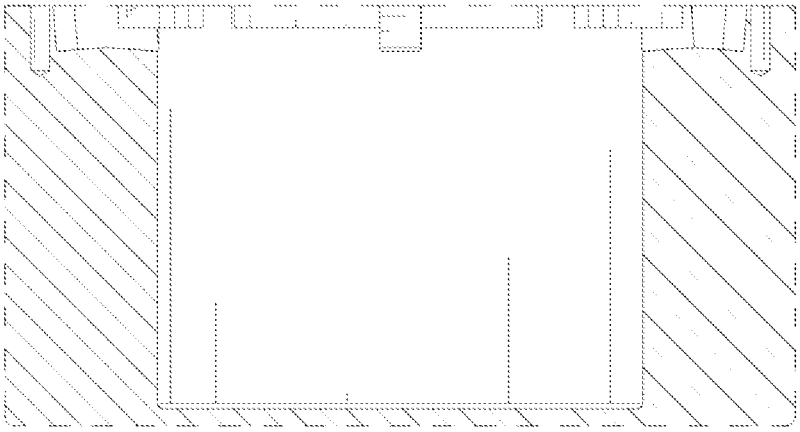
FIG. 32 is a hemisection view of the assembled puzzle box along line 32 of FIG. 30, as contemplated by the present disclosure.
Figure 33:
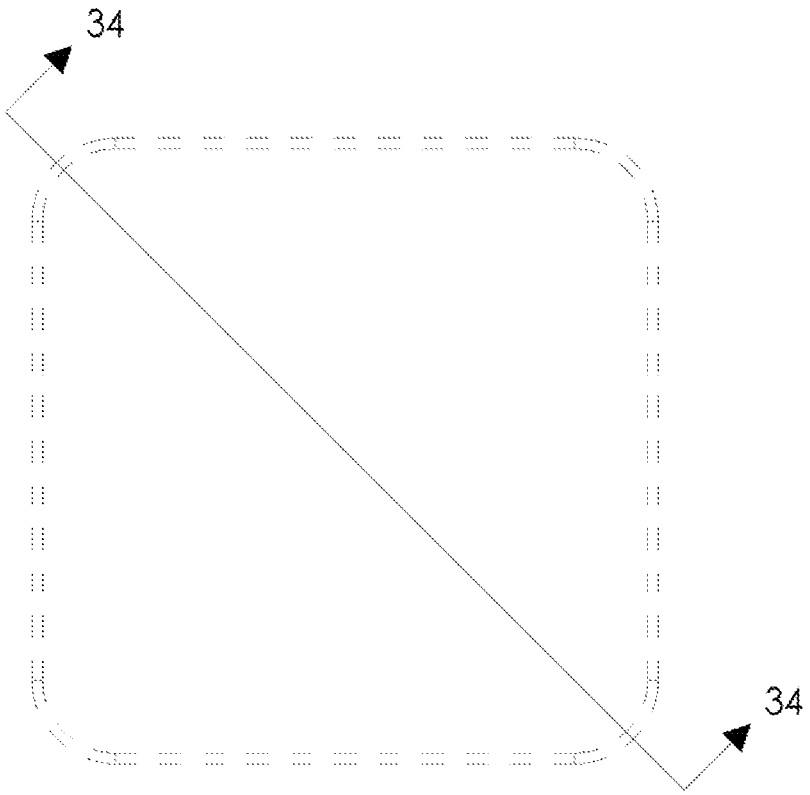
FIG. 33 is a top plan view of the assembled puzzle box, as contemplated by the present disclosure.
Figure 34:
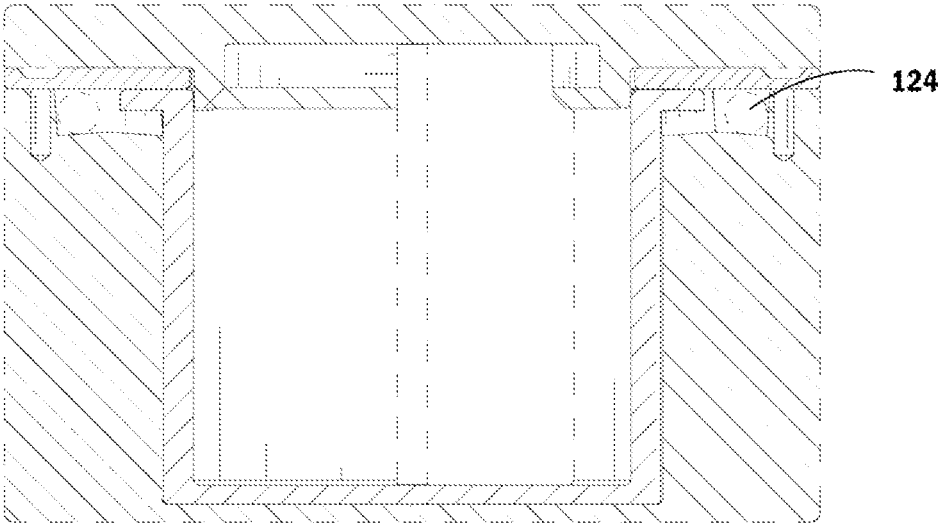
FIG. 34 is a hemisection view of the assembled puzzle box along line 34 of FIG. 33, as contemplated by the present disclosure.

The illustration of FIG. 12 represents a completely assembled, locked, and closed internal locking mechanism assembly 100, and may include a base 110, a plate 114, a lid 116, and a single or plurality of divot 120. A divot 120 may be situated on either or both the lid 116 or bottom of base 110.

The primary locking function of the puzzle storage box works as such: one each of a plurality of ball bearings 124 is positioned within one each of the bearing channels 214 in the base 110 or the plate 114. When any one of the ball bearings 124 is in the proximal end of its bearing channel 214 that ball bearing interferes with the relative movement of the lid 116 and the base 110 by blocking one of the cup tabs 312 or lid tabs 510, depending on the particular embodiment. The illustrations of FIGS. 7 and 8 show that, in FIG. 7, when the cup 112 is rotated relative to the base 110, to the locked position, all of the bearing channels 214 are exposed and allow for free movement of a ball bearing 124 therein. FIG. 8 shows that when the cup 112 is rotated relative to the base 110, to the unlocked position, all of the bearing channels 214 are blocked thus requiring the ball bearings 124 to be located in a distal end of the bearing channel 214.

Because of the nature of this locking mechanism there is a particular method required to unlock the device. To unlock the puzzle storage box a user must first spin the device on a vertical axis while ensuring that the device is relatively flat. This spinning causes the plurality of ball bearings 124 to move to the distal ends of their respective bearing channels 214 by centrifugal force. The user must then hold the device level so that the ball bearings 124 do not move from these distal positions. The user may then rotate the lid 116 relative to the base 110 to unlock and remove the lid and access the contents inside. If the device is not first spun to displace the ball bearings 124, or is not maintained in a horizontal and level attitude, one or more of the ball bearings 124 will move to the proximal aspect of its bearing channel 214 and interfere with the unlocking process thus preventing the lid from being rotated and removed.

The puzzle storage box may be substantially constructed of any suitable material or combination of materials, but typically is constructed of a resilient material or combination of materials such that the device is easily manufactured, insulating, and reusable. As an example, and without limiting the scope of the present invention, various exemplary embodiments of the puzzle storage box may be substantially constructed of one or more materials of plastic, acrylic, polycarbonate, fabric, steel, aluminum, brass, fiberglass, carbon fiber, or combinations thereof. In some embodiments the various components of the device may be coated, lined, or otherwise insulated to prevent contamination of the device.

In one embodiment the puzzle storage box may comprise a resilient material of construction that either comprises a material having antimicrobial properties or comprises a layering of antimicrobial material or coating. Antimicrobial properties comprise the characteristic of being antibacterial, biocidal, microbicidal, anti-fungal, anti-viral, or other similar characteristics, and the oligodynamic effect, which is possessed by copper, brass, silver, gold, and several other metals and alloys, is one such characteristic. Copper and its alloys, in particular, have exceptional self-sanitizing effects. Silver also has this effect, and is less toxic to users than copper. Some materials, such as silver in its metallic form, may require the presence of moisture to activate the antimicrobial properties.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A puzzle storage box, comprising:

a base;

a plate;

a lid;

a cup; and a plurality of ball bearings;

wherein said base further comprises a plurality of cup channels, a plurality of bearing channels, and a central cavity;

wherein said plate is attached to a top side of said base;

wherein said plate further comprises a plurality of plate lid tab voids;

wherein said cup further comprises a plurality of cup tabs and a plurality of cup lid tab voids, wherein said cup is inserted into said central cavity of said base such that one each of said cup tabs of said cup sits within one each of said plurality of cup channels of said base;

wherein said lid further comprises a plurality of tabs;

wherein one each of said plurality of tabs of said lid fit through one each of said plurality of plate lid tab voids of said plate and into one each of said plurality of cup lid tab voids of said cup when said lid is in an unlocked orientation;

wherein one each of said plurality of tabs of said lid rotate axially into one each of said plurality of cup channels of said base when said lid is in a locked orientation;

wherein one each of said bearing channels contains one each of said ball bearings;

wherein one each of said ball bearings is restrained to a distal end of one each of said bearing channels when said lid is in said unlocked orientation; and wherein one each of said ball bearings moves freely within its one each of said bearing channels when said lid is in said locked orientation.

2. The puzzle storage box of claim 1, further comprising:

a plurality of inserts;

wherein said plurality of inserts fit into said cup.

* * * * *